US009733608B2

(12) United States Patent
Jota et al.

(10) Patent No.: US 9,733,608 B2
(45) Date of Patent: Aug. 15, 2017

(54) DETERMINING LIGHT QUANTITY OF PRE-CHARGING EXPOSURE DEVICE IN AN IMAGE FORMING APPARATUS AND CARTRIDGE

(71) Applicant: CANON KABUSHIKI KAISHA, Tokyo (JP)

(72) Inventors: Yusuke Jota, Suntou-gun (JP); Hisashi Taniguchi, Suntou-gun (JP); Yoshihiro Mitsui, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/071,270

(22) Filed: Mar. 16, 2016

(65) Prior Publication Data

US 2016/0274482 A1 Sep. 22, 2016

(30) Foreign Application Priority Data

Mar. 19, 2015 (JP) ..... 2015-055898

(51) Int. Cl.

| | |
|---|---|
| ***G03G 21/00*** | (2006.01) |
| ***G03G 15/043*** | (2006.01) |
| ***G03G 21/08*** | (2006.01) |
| ***G03G 15/02*** | (2006.01) |

(52) U.S. Cl.

CPC ..... *G03G 21/0094* (2013.01); *G03G 15/0266* (2013.01); *G03G 15/043* (2013.01); *G03G 21/08* (2013.01)

(58) Field of Classification Search

CPC ..... G03G 21/0094; G03G 21/06; G03G 21/08

USPC ..... 399/127, 128

See application file for complete search history.

(56) References Cited

U.S. PATENT DOCUMENTS 7,463,849 B2 * 12/2008 Takuma ..... G03G 21/08 399/128
7,844,200 B2 * 11/2010 Kanai ..... G03G 15/0208 399/128
7,848,679 B2 * 12/2010 Kanai ..... G03G 15/0266 399/128

(Continued)

FOREIGN PATENT DOCUMENTS

JP 2001265184 A * 9/2001
JP 2009042738 A 2/2009

(Continued)

*Primary Examiner* — Robert Beatty

(74) *Attorney, Agent, or Firm* — Rossi, Kimms & McDowell LLP

(57) ABSTRACT

An image forming apparatus includes an image bearing member, a charging member, a developing member, a transfer unit, a pre-charging exposure unit, a voltage receiving member, a measuring portion, and a controller for determining a light quantity of the pre-charging exposure unit during image formation. The controller includes, a light quantity controller for controlling the light quantity so that the image bearing member charged by applying a first potential to the charging member is exposed to light at a first light quantity by the pre-charging exposure unit, and an acquiring portion for acquiring an output of the measuring portion when the image bearing member exposed to light at the first light quantity is charged by applying a second potential of an opposite polarity to a polarity of the first potential to the voltage receiving member.

14 Claims, 6 Drawing Sheets

(56) References Cited

U.S. PATENT DOCUMENTS

| | | | | |
|---|---|---|---|---|
| 8,005,380 | B2 * | 8/2011 | Kubo | G03G 15/0266 399/128 |
| 2016/0209772 | A1 * | 7/2016 | Soda | G03G 15/0283 |
| 2016/0334730 | A1 * | 11/2016 | Soda | G03G 15/043 |

FOREIGN PATENT DOCUMENTS

| | | | | |
|---|---|---|---|---|
| JP | 2009175675 | A | | 8/2009 |
| JP | 2010156853 | A | * | 7/2010 |

* cited by examiner

| | APPLIED VOLTAGE VALUE |
|---|---|
| FIRST EMB. | +1500 [V] |
| COMP.EX.1 | -2500 [V] |

| | REQUIRED TIME |
|---|---|
| SECOND EMB. | 1.64 [s] |
| FIRST EMB. | 1.80 [s] |

FIG.8

DETERMINING LIGHT QUANTITY OF PRE-CHARGING EXPOSURE DEVICE IN AN IMAGE FORMING APPARATUS AND CARTRIDGE

FIELD OF THE INVENTION AND RELATED ART

The present invention relates to an image forming apparatus for forming an image on a recording material (such as recording paper, an OHP sheet or a cloth) and a cartridge for use with the image forming apparatus.

Conventionally, with respect to a light quantity of a pre-charging exposure device, there was a need to adjust the light quantity to an optimum value depending on a manufacturing variation in film thickness of an electrophotographic photosensitive member, sensitivity of the electrophotographic photosensitive member or the like or depending on a change with use of the photosensitive member. For that reason, Japanese Laid-Open Patent Applications 2009-175675 and 2009-042738 propose a method in which a value of a charging current flowing when a region where the photosensitive member is exposed to light by turning on the pre-charging exposure device is electrically charged again by a contact charging member is measured and on the basis of a result of measurement, a light quantity of the pre-charging exposure device during image formation is determined.

However, an image forming apparatus in which the light quantity of the pre-charging exposure device is determined by such a method had the following problem. Conventionally, in control for determining the light quantity of the pre-charging exposure device, a measuring means for measuring a value of a voltage applied to a potential detecting member, for not only charging the photosensitive member but also detecting a potential of the photosensitive member after the photosensitive member is exposed to light by the pre-charging exposure device, or a value of a current flowing through the potential detecting member is used. In this case, a polarity of a potential applied to the potential detecting member was the same as a polarity of a toner applied to the charging member for charging the photosensitive member during the image formation.

Then, an absolute value of the potential applied to the potential detecting member becomes high. For example, when the potential is −500 V before application, the potential is increased to −2500 V in absolute value. For this reason, conventionally, there was problems that a high charging power device is required as a voltage source device for a measuring means, that a cost of the voltage source device increases and that a large voltage source device is required to be used, and the like problem.

SUMMARY OF THE INVENTION

A principal object of the present invention is to provide an image forming apparatus and a cartridge which provide a further improvement of the above-described conventional constitution in which a paper light quantity for pre-charging exposure is determined.

According to an aspect of the present invention, there is provided an image forming apparatus comprising: an image bearing member; a charging member for electrically charging the image bearing member at a charging portion; a developing member for forming a developer image on the image bearing member charged by the charging member; a transfer unit for transferring the developer image onto a transfer material at a transfer portion; a pre-charging exposure unit for exposing to light a surface of the image bearing member which passes through the transfer portion and before reaches the charging portion; a voltage receiving member for receiving a voltage to detect a potential of the image bearing member; a measuring portion for measuring a value of a voltage applied to the voltage receiving member when constant-current control is effected or a value of a current flowing through the voltage receiving member when constant-voltage control is effected; and a controller for determinating a light quantity of the pre-charging exposure unit during image formation, wherein the controller includes, a light quantity controller for controlling the light quantity so that the image bearing member charged by applying a first potential to the charging member is exposed to light at a first light quantity by the pre-charging exposure unit, and an acquiring portion for acquiring an output of the measuring portion when the image bearing member exposed to light at the first light quantity is charged by applying a second potential of an opposite polarity to a polarity of the first potential to the voltage receiving member.

According to another aspect of the present invention, there is provided a cartridge detachably mountable to a main assembly of an image forming apparatus, the cartridge comprising: an image bearing member on which a developer image to be transferred onto a transfer material at a transfer portion is to be formed; a charging member for electrically charging the image bearing member at a charging portion; a pre-charging exposure unit for exposing to light a surface of the image bearing member which passes through the transfer portion and before reaches the charging portion; and a controller for determinating a light quantity of the pre-charging exposure unit during image formation, wherein the controller includes, a light quantity controller for controlling the light quantity so that the image bearing member charged by applying a first potential to the charging member is exposed to light at a first light quantity by the pre-charging exposure unit, and an acquiring portion for acquiring an output of a measuring portion when the image bearing member exposed to light at the first light quantity is charged by applying a second potential of an opposite polarity to a polarity of the first potential to a voltage receiving member for detecting a potential of the image bearing member, wherein the measuring portion measures a value of a voltage applied to the voltage receiving member when constant-current control is effected or a value of a current flowing through the voltage receiving member when constant-voltage control is effected.

Further features of the present invention will become apparent from the following description of exemplary embodiments with reference to the attached drawings.

BRIEF DESCRIPTION OF THE DRAWINGS

FIG. 8 is a table showing a comparison of times required for the determining source of the proper light quantity of the pre-charging exposure device in First and Second Embodiments.

DESCRIPTION OF THE EMBODIMENTS

<First Embodiment>

An embodiment of the present invention will be described specifically with reference to the drawings. With respect to dimensions, materials, shapes, relative arrangements of constituent elements or portions described in this embodiment, the scope of the present invention is not intended to be limited thereto unless otherwise specified particularly.

(Image Forming Apparatus)

First, using FIG. 2, a general structure of an image forming apparatus 100 in this embodiment will be described. In this embodiment, as an example of the image forming apparatus 100, a laser beam printer is used and described, but an electrophotographic copying machine, a facsimile machine and the like are also applicable. The image forming apparatus 100 in this embodiment includes a photosensitive drum 10 (image bearing member) for forming an image thereon using an electrostatic latent image while being rotationally driven in an arrow A direction in FIG. 2 by a driving source (not shown).

Figure 2:
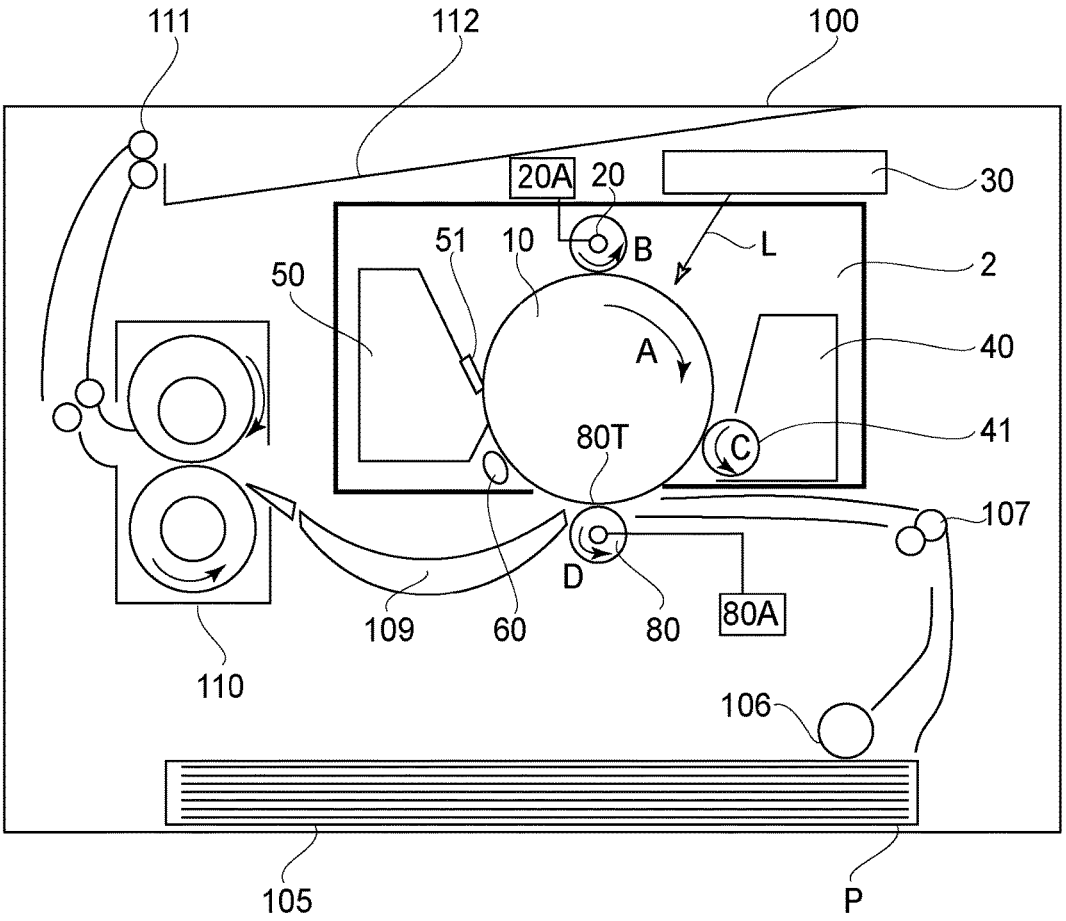
FIG. 2 is a schematic view showing a general structure of an entirety of an image forming apparatus in First Embodiment of the present invention.

In FIG. 2, a process cartridge 2 is detachably mountable to a main assembly of the image forming apparatus 100 and includes the photosensitive drum 10, a charging roller 20, a developing device 40, a cleaning device 50 and a pre-charging exposure device 60. The pre-charging exposure device 60 uniformize a surface potential, of the photosensitive drum 10 after transfer by a transfer means described later, by exposure before charging by the charging roller 20.

In this embodiment, as the photosensitive drum 10, an organic photosensitive member prepared by coating, on an outer peripheral surface of an aluminum-made cylinder, functional films of an undercoat layer, a carrier generating layer and a carrier transporting layer in the listed order was used. Further, as shown in FIG. 2, at a periphery of the photosensitive drum 10, the charging roller 20, an exposure device 30 used during image formation, the developing device 40, the cleaning device 50, the pre-charging exposure device 60 used during non-image formation, and a transfer roller 80 as a transfer means are provided.

The cartridge 20 (charging member, charging means) for electrically charging the photosensitive drum 10 is rotated in an arrow B direction in FIG. 2 by press-contact with the photosensitive drum 10 at a surface portion of an electroconductive rubber. With a core metal of the charging roller 20, a voltage source 20A is connected and applies a predetermined DC voltage to the core metal, so that electric discharge is caused to generate in a minute gap between the charging roller 20 and the photosensitive drum 10 and thus the surface of the photosensitive drum 10 is charged to a uniform dark-portion potential. A portion where the electric discharge to the photosensitive drum 10 is made by the charging roller 20 is referred to as a charging portion, and a contact portion between the charging roller 20 and the photosensitive drum 10 is principally included in the charging portion.

The surface of the photosensitive drum 10 is irradiated with laser light emitted on the basis of image information by the exposure device 30 as an exposure means. At a portion where the photosensitive drum 10 is irradiated with the laser light, an electric charge at the photosensitive drum surface disappears by a carrier from the carrier generating layer, so that a surface potential lowers. As a result, an electrostatic latent image for which a potential at an exposed portion (image portion) where the laser light irradiation is made is a predetermined light-portion potential and a potential at a non-exposure portion (non-image portion) where the laser light irradiation is not made is a predetermined dark-portion potential is formed on the surface of the photosensitive drum 10.

The developing device 40 develops the electrostatic latent image formed on the surface of the photosensitive drum 10, so that a toner image as a developer image is formed. The developing device 40 incorporates a developing roller 41 as a developer carrying member, and the developing roller 41 contacts the photosensitive drum 10 and is provided rotatably in an arrow C direction in FIG. 2. The developing roller 41 and the photosensitive drum 10 rotate so that surfaces of these members move in the same direction at a contact portion (opposing portion) therebetween.

The developer on the developing roller 41 is fed to the contact portion with the photosensitive drum 10 by the rotation of the developing roller 41, so that the electrostatic latent image formed on the photosensitive drum 10 visualized. As a result, the toner image as the developer image is formed on the photosensitive drum 10. In this embodiment, as the developer, a non-magnetic one-component toner is used, and as a developing type, a one-component contact developing type is employed.

A voltage source 80A is connected with a core metal of the transfer roller 80 provided rotatably in an arrow D direction in FIG. 2. A potential of an opposite polarity to a charge potential of the developer is applied to the core metal of the transfer roller 80, so that the toner image formed on the photosensitive drum 10 is transferred onto a transfer material P such as paper as a recording material at a transfer nip (transfer portion) 80T (FIG. 2). The toner remaining on the photosensitive drum 10 without being transferred onto the transfer material P is collected by the cleaning device 50. In this embodiment, a residual toner on the photosensitive drum 10 is removed and collected using a cleaning blade 51 consisting of an elastic blade, and the photosensitive drum 10 cleaned at the surface thereof is subjected repetitively to image formation.

(Pre-charging Exposure Device (Pre-charging Exposure Unit))

The surface of the photosensitive drum 10 after passing through the transfer nip 80T during image formation has a non-uniform surface potential depending on a formed image pattern. In this state, when the surface of the photosensitive drum 10 is intended to be charged by applying a potential from the charging voltage source 20A to the charging roller 20, the surface of the photosensitive drum 10 cannot be charged uniformly. For example, in the case where a halftone image is formed after a high-contrast image pattern is formed, such a problem that a preceding image pattern (image) appears on the halftone image (ghost image) generates.

Therefore, by the pre-charging exposure device 60, the surface of the photosensitive drum 10 after passing through the transfer nip 80T is uniformly irradiated with light, so that a surface potential of the photosensitive drum 10 is made uniform. As a result, even when the surface potential of the photosensitive drum 10 is non-uniform depending on the image pattern, by exposing the photosensitive drum surface to light by the pre-charging exposure device 60, it becomes possible to uniformly charge the photosensitive drum surface by the charging roller 20.

On the other hand, in the case where the photosensitive drum 10 is irradiated with light at a high light quantity by the pre-charging exposure device 60, the surface potential of the photosensitive drum 10 after the charging exposure lowers. For this reason, there is an inconvenience such that an amount of electric discharge generating in a minute gap between the charging roller 20 and the photosensitive drum 10 increases to damage the surface of the photosensitive drum 10 and thus an abrasion amount of the photosensitive drum 10 increases to shorten a lifetime of the photosensitive drum 10 due to endurance.

Therefore, there is a need to control a light quantity of the pre-charging exposure device 60 to within a desired range, so that there is a need to effect control for adjusting the light quantity of the pre-charging exposure device 60. Description of this control will be omitted here since details of the control will be specifically described later.

Figure 3:
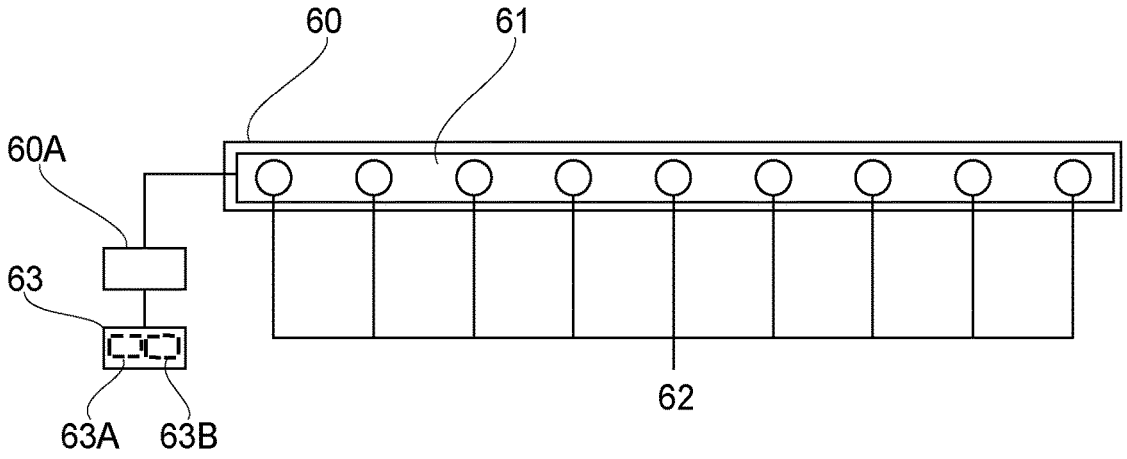
FIG. 3 is a schematic sectional view of the pre-charging exposure device with respect to a recording material widthwise direction.

FIG. 3 is a sectional view of the pre-charging exposure device 60 with respect to a recording material widthwise direction in this embodiment. The pre-charging exposure device 60 includes a pre-exposure substrate 61 and a pre-exposure light source 62. With the pre-charging exposure device 60, a pre-exposure voltage source 60A and a pre-exposure light quantity controller 63 are connected. The pre-exposure light quantity controller 63 includes a light quantity controller 63A described specifically later and an acquiring portion 63B for acquiring an output from a measuring portion. The pre-exposure light quantity controller 63 is constituted by an electric circuit including a computing means such as CPU or ASIC and a storing medium such as RAM.

In this embodiment, the relational expression light source 62 is disposed on the pre-exposure substrate 61, electric power is supplied from the pre-exposure voltage source 60A to the pre-exposure light source 62, so that the photosensitive drum 10 is exposed to light. The light quantity of the pre-exposure light source 62 is controlled by adjusting an amount of a current, supplied to the pre-exposure voltage source 60A, by the pre-exposure light quantity controller 63. In this embodiment, as the pre-exposure light source 62, a chip-type LED was employed since a driving voltage was small and downsizing was easy.

On the pre-exposure substrate 61, nine pre-exposure light sources 62 were disposed at regular intervals so as to provide an LED interval of 24 mm (between adjacent two LEDs). The pre-exposure light source 62 is not limited to the chip-type LED, but may also be of a type in which the photosensitive drum 10 is laterally irradiated with light by a shell-type LED, a type using a light guide or a type using a halogen lamp or the like. In this embodiment, as the pre-exposure light source 62, a mini-mold chip LED ("SML-D12V8 W", manufactured by ROHM Co., Ltd., wavelength: 630 nm) was used.

(Transfer Unit)

In this embodiment, a transfer unit also functions as an image bearing member potential detecting member (potential detecting portion for detecting the potential of the image bearing member). The transfer unit in this embodiment includes the transfer roller 80 as a voltage applying member, the transfer voltage source 80A, a transfer controller 81 and a transfer measuring portion 82 as a measuring portion. The transfer voltage source 80A has the function of switching a polarity of a potential to be outputted. The transfer voltage source 80A is controlled so that polarities of voltages applied from the transfer voltage source 80A to the transfer roller 80 are different from each other in a first charging operation and a second charging operation in a light quantity determining sequence for the pre-charging exposure device 60 as described below.

(Determining Sequence of Proper Light Quantity of Pre-charging Exposure Device)

Figure 1:
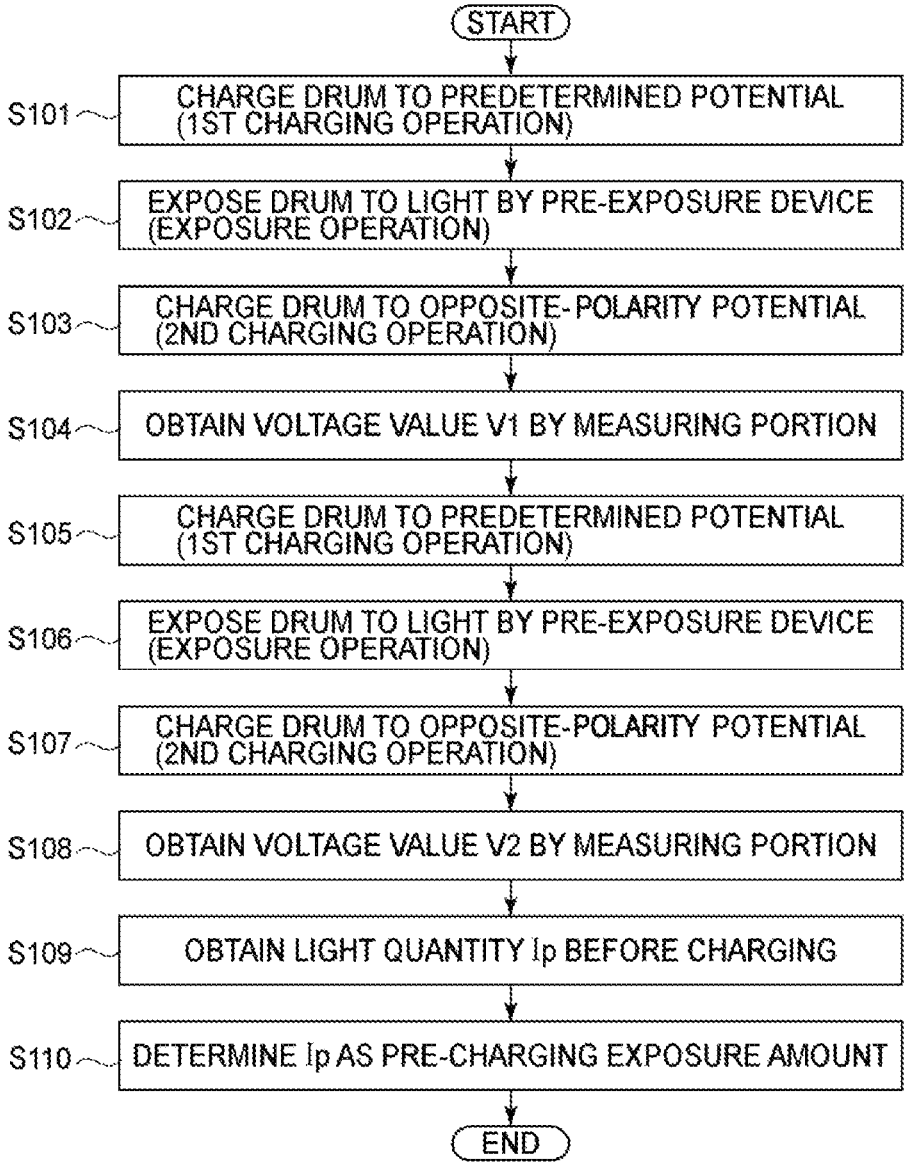
FIG. 1 is a flowchart of a determining source of a proper light quantity of a pre-charging exposure device in First Embodiment.

FIG. 1 is a flow chart of a determining source of a proper light quantity of the pre-charging exposure device in this embodiment. In this embodiment, when pre-charging exposure is made at different two pre-charging exposure light quantities, measurement of associated voltage values is made by the transfer measuring portion 82. That is, the measurement at a first pre-charging exposure light quantity I1 is made in steps S101 to S104 in FIG. 1, and the measurement at a second pre-charging exposure light quantity I2 is made in steps S105 to S108. On the basis of a result of each of the measurements, in steps S109 and S110, a pre-charging exposure light quantity during image formation is determined. The respective steps will be described in details.

Figure 4:
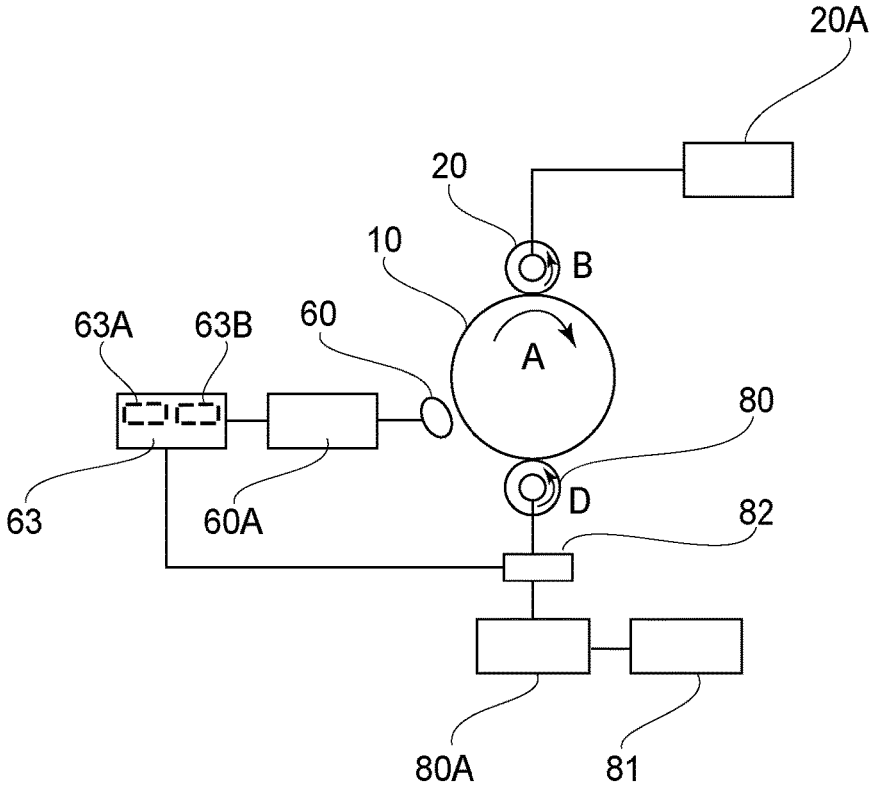
FIG. 4 is a schematic structural view of members relating to the determining source of the proper light quantity of the pre-charging exposure device in First Embodiment.

In the step S101 in FIG. 1, the photosensitive drum 10 is charged to a predetermined potential (first potential) by applying a potential from the charging voltage source 20A to the charging roller 20 (charging member) as shown in FIG. 4. That is, the step S101 corresponds to the first charging operation in the measurement at a first pre-exposure light quantity. In this embodiment, the photosensitive drum 10 is charged to −600 V.

Then, in the step S102, by the light quantity controller 63A (FIGS. 3 and 4), a region of the photosensitive drum 1 after execution of the first charging operation is exposed to light at a predetermined light quantity (first light quantity) by the pre-charging exposure device 60 shown in FIG. 4 (pre-charging exposure light quantity I1). That is, the step S102 corresponds to an exposure operation in the measurement at the first pre-exposure light quantity. In this embodiment, the first pre-charging exposure light quantity is 3.0 μA.

Then, in the step S103, the photosensitive drum 10 is charged by applying a potential of an opposite polarity to the polarity of the potential applied to the charging roller 20 in the first charging operation from the transfer voltage source 80A to the transfer roller 80 (image bearing member potential detecting member) as shown in FIG. 4. That is, the step S103 corresponds to the second charging operation in the measurement at the first pre-exposure light quantity.

Then, in the step S104, during execution of the second charging operation, a value of a voltage applied to the transfer roller 80 is controlled by the transfer controller 81 so that a current having a predetermined value flows through the transfer roller 80 shown in FIG. 4. In this embodiment, the value of the current flowing through the transfer roller 80 is controlled to 5.0 μA by the transfer controller 81. At that time, the value of the voltage applied to the transfer roller 80 is measured by the transfer measuring portion 82 shown in FIG. 4 at a certain measuring interval (20 ms in this embodiment).

An output (measurement result by the measuring operation) of the transfer measuring portion 82 as the measuring portion is acquired (obtained) by an acquiring (obtaining) portion 63B (FIGS. 3 and 4). Then, the photosensitive drum 10 is rotated one-full circumference and then measurement is made, and a timewise average of measured values is taken as a voltage value V1.

In this sequence, the steps S101 to S104 relate to the measurement at the first pre-charging exposure light quantity I1.

Then, the light quantity is changed and the measurement at the second pre-charging exposure light quantity I2 is similarly performed. Similarly, as in the step S101, the photosensitive drum 10 is charged to a predetermined potential (first potential) by applying a potential from the charging voltage source 20A to the charging roller 20 (charging member) as shown in FIG. 4. That is, the step S105 corresponds to the first charging operation in the measurement at a second pre-exposure light quantity. In this embodiment, the photosensitive drum 10 is charged to −600 V.

Then, in the step S106, by the light quantity controller 63A, a region of the photosensitive drum 1 after execution of the first charging operation is exposed to light by being irradiated with light at a light quantity different from that in the step S102 by the pre-charging exposure device 60 shown in FIG. 4 (pre-charging exposure light quantity I2). That is, the step S106 corresponds to an exposure operation in the measurement at the second pre-exposure light quantity. In this embodiment, the second pre-charging exposure light quantity is 8.0 μA.

Then, in the step S107, similarly as in the step S103, the photosensitive drum 10 is charged by applying a potential of an opposite polarity to the polarity of the potential applied to the charging roller 20 in the first charging operation from the transfer voltage source 80A to the transfer roller 80 (image bearing member potential detecting member) as shown in FIG. 4. That is, the step S107 corresponds to the second charging operation in the measurement at the second pre-exposure light quantity.

Then, in the step S108, similarly as in the step S104, during execution of the second charging operation, a value of a voltage applied to the transfer roller 80 is controlled by the transfer controller 81 so that a current having a predetermined value flows through the transfer roller 80 shown in FIG. 4. In this embodiment, the value of the current flowing through the transfer roller 80 is controlled to 5.0 μA by the transfer controller 81. At that time, the value of the voltage applied to the transfer roller 80 is measured by the transfer measuring portion 82 shown in FIG. 4 at a certain measuring interval (20 ms in this embodiment).

Then, the photosensitive drum 10 is rotated one-full circumference and then measurement is made, and a timewise average of measured values is taken as a voltage value V2.

In this sequence, the steps S105 to S108 relate to the measurement at the second pre-charging exposure light quantity I2.

Measurement results (voltage values V1 and V2) acquired by the measuring operation (step S104 and step 108) performed by a plurality of times and light quantities I1 and I2 of the pre-charging exposure device at that time are stored in an unshown storing portion of the acquiring portion 63B.

Then, a relational expression (1) between the voltage value V measured by the transfer measuring portion 82 and the pre-charging exposure light quantity I is acquired from the measurement results (voltage values V1 and V2) acquired by the acquiring portion 63B in the measuring operation (step S104 and step S108) performed by the plurality of times and the light quantities I1 and I2 of the pre-charging exposure device at that time. Calculation of the relational expression (1) is made by the pre-exposure light quantity controller 63.

$$V=P\times I+V01 \quad (1)$$

In the above relational expression (1), P=(V2−V1)/(I2−I1). V01 represents a voltage value measured by the transfer measuring portion 82 when the pre-charging exposure light quantity I is 0.

Then, a measurement voltage value Vp, at the transfer roller 80, where the potential of the photosensitive drum 10 is desired pre-charging potential is acquired in advance, and the pre-exposure light quantity controller 63 acquires, from the relational expression (1), a light quantity Ip corresponding to the measurement voltage value Vp providing the desired pre-exposure potential (step S109). Finally, the pre-exposure light quantity controller 63 determines the acquired pre-charging exposure light quantity Ip as a pre-charging exposure light quantity used during the image formation (step S110), and then ends the light quantity determining sequence.

As described above, in this embodiment, at the different two pre-charging exposure light quantities I1 and I2, by measuring the voltage values V1 and V2 by the transfer measuring portion, P=(V2−V1)/(I2−I1) in the relational expression (1) is determined, and the pre-charging exposure light quantity is determined from the relational expression (1).

A rotational speed of the photosensitive drum 10 in the determining source of the proper light quantity may preferably be slower than a rotational speed of the photosensitive drum 10 during the image formation in which the developer image is formed on the photosensitive drum 10.

(Verification of Effect)

A verification test for verifying an effect of this embodiment will be described. As a comparison example (COMP. EX. 1) in this verification test, a light quantity determining sequence for the pre-charging exposure device was performed in a state in which the polarities of the potentials applied in the first and second charging operations were made the same and a result thereof was compared with the result of the light quantity determining sequence in this embodiment.

Figures 5, 6:
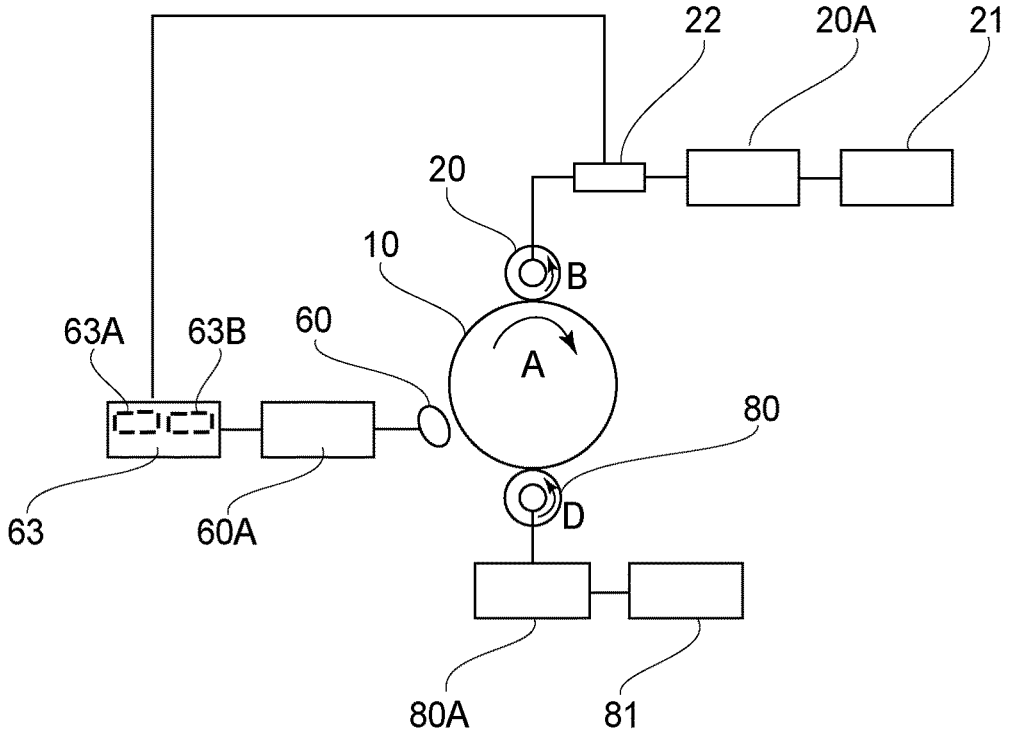
FIG. 5 is a table showing a comparison of polarities of potentials applied during a second charging operation.
FIG. 6 is a schematic structural view of members relating to a determining source of a proper light quantity of a pre-charging exposure device in Second Embodiment.

FIG. 5 is a table showing a result of the verification test, and shows a result of comparison of the potential applied in the second charging operation in the light quantity determining sequence between this embodiment ("First EMB.") and Comparison Example 1 ("COMP. EX. 1"). In the verification test, the light quantity determining sequence was performed at the potential, of −500 V, of the photosensitive drum 10 after the pre-charging exposure, and the values of the voltages applied to the transfer roller 80 as the image bearing member potential detecting member were compared. As a result, in the constitution in this embodiment, the potential applied to the transfer roller 80 was +1500 V. On the other hand, in the constitution in Comparison Example 1, the potential applied to the transfer roller 80 was −2500 V.

As a result, it turned out that compared with Comparison Example 1, the absolute value of the potential applied in the second charging operation in the constitution in this embodiment was lowered by 1000 V. In both of the constitutions, the control is effected by the transfer controller 81 so that a constant current flows through the transfer roller 80 in the second charging operation, so that the potential difference between the photosensitive drum 10 and the transfer roller 80 is the same in both of the constitutions (in the case of this verification test, the potential difference was 2000 V in both of the constitutions).

Therefore, in the constitution in this embodiment, the absolute value of the potential applied in the second charging operation was able to be suppressed to a low level. As a result, compared with the constitution in Comparison Example 1, it is possible to suppress the absolute value of the potential applied in the second charging operation in the light quantity determining sequence to the low level. In addition, there is no need to use a device having high charging power as the voltage source device (transfer voltage source 80A) for the measuring member (transfer measuring portion 82) in this embodiment, and therefore it becomes possible to suppress a cost of the voltage source device for the measuring member.

<Second Embodiment>

Second Embodiment of the present invention will be described. In First Embodiment, the transfer unit was used as the image bearing member potential detecting member in the light quantity determining sequence of the pre-charging exposure device 60, but in this embodiment, a charging unit is used also as the image bearing member potential detecting member. In the following description, portions similar to those in First Embodiment described above will be omitted from description. A constitution of members relating to the light quantity determining sequence of the pre-charging exposure device in this embodiment is shown in FIG. 6.

(Transfer Unit)

In this embodiment, the charging unit also functions as the image bearing member potential detecting member. The charging unit in this embodiment includes the charging roller 20 shown in FIG. 6, the charging voltage source 20A, a charging controller 21 and a charging measuring portion 22. The charging voltage source 20A has the function of switching a polarity of a potential to be outputted. The charging voltage source 20A is controlled so that polarities of voltages applied from the charging voltage source 20A to the charging roller 20 are different from each other in a first charging operation and a second charging operation in a light quantity determining sequence for the pre-charging exposure device 60.

(Determining Sequence of Light Quantity of Pre-charging Exposure Device)

Figure 7:
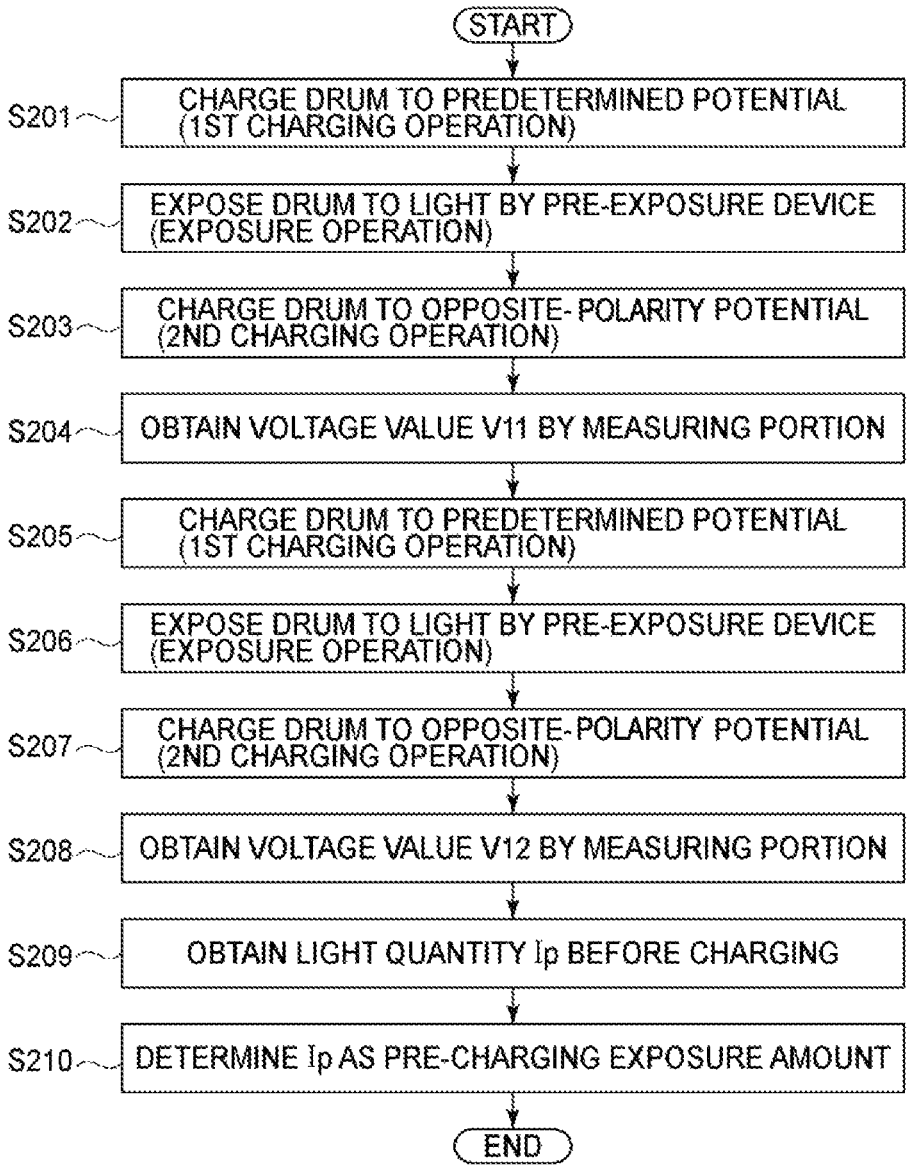
FIG. 7 is a flowchart of the determining source of the proper light quantity of the pre-charging exposure device in Second Embodiment.

FIG. 7 is a flow chart of a determining source of a light quantity of the pre-charging exposure device in this embodiment. Also in this embodiment, similarly as in First Embodiment, when measurement is made at different two pre-charging exposure light quantities. That is, the measurement at a first pre-charging exposure light quantity I11 is made in steps S201 to S204 in FIG. 1, and the measurement at a second pre-charging exposure light quantity I12 is made in steps S205 to S208. On the basis of a result of each of the measurements, in steps S209 and S210, a pre-charging exposure light quantity is determined. The respective steps will be described in details.

In the step S201 in FIG. 7, the photosensitive drum 10 is charged to a predetermined potential by applying a potential from the charging voltage source 20A to the charging roller 20 as shown in FIG. 6 (step S201: first charging operation at a first pre-exposure light quantity). In this embodiment, the photosensitive drum 10 is charged to −600 V.

Then, a region of the photosensitive drum 1 after execution of the first charging operation is exposed to light by light irradiation from the pre-charging exposure device 60 (step S202: exposure operation in the measurement at the first pre-exposure light quantity). In this embodiment, the first pre-charging exposure light quantity is 3.0 μA.

Then, the photosensitive drum 10 is charged by applying a potential of an opposite polarity to the polarity of the potential applied to the charging roller 20 in the first charging operation from the charging voltage source 20A to the charging roller 20 (step S203: second charging operation in the measurement at the first pre-exposure light quantity).

Then, during execution of the second charging operation, a value of a voltage applied to the charging roller 20 is controlled by the charging controller 21 so that a current having a predetermined value flows through the charging roller 20 (step S204). In this embodiment, the value of the current flowing through the charging roller 20 is controlled to 5.0 μA by the charging controller 21. At that time, the value of the voltage applied to the charging roller 20 is measured by the charging measuring portion 22 at a certain measuring interval (20 ms in this embodiment). Then, the photosensitive drum 10 is rotated one-full circumference and then measurement is made, and a timewise average of measured values is taken as a voltage value V11.

In this sequence, the steps S201 to S204 relate to the measurement at the first pre-charging exposure light quantity I11.

Then, similarly, as in the step S201, the photosensitive drum 10 is charged to a predetermined potential (first potential) by applying a potential from the charging voltage source 20A to the charging roller 20 (charging member) (step S205: first charging operation in the measurement at a second pre-exposure light quantity). In this embodiment, the photosensitive drum 10 is charged to −600 V. Then, a region of the photosensitive drum 1 after execution of the first charging operation is exposed to light by being irradiated with light at a light quantity different from that in the step S202 by the pre-charging exposure device 60 (pre-charging exposure light quantity I12) (step S206: exposure operation in the measurement at the second pre-exposure light quantity). In this embodiment, the second pre-charging exposure light quantity is 8.0 μA.

Then, similarly as in the step S203, the photosensitive drum 10 is charged by applying a potential of an opposite polarity to the polarity of the potential applied from the charging voltage source 20A to the charging roller 20 in the first charging operation from the charging voltage source 20A to the charging roller 20 (image bearing member potential detecting member) (step S207). The step S207 corresponds to the second charging operation in the measurement at the second pre-exposure light quantity. Then, in the step S208, similarly as in the step S204, during execution of the second charging operation, a value of a voltage applied from the charging voltage source 20A to the charging roller 20 is controlled by the charging controller 21 so that a current having a predetermined value flows through the charging roller 20. In this embodiment, the value of the current flowing through the charging roller 20 is controlled to 5.0 μA by the charging controller 21.

At that time, the value of the voltage applied to the charging roller 20 is measured by the charging measuring portion 22 at a certain measuring interval (20 ms in this embodiment). Then, the photosensitive drum 10 is rotated one-full circumference and then measurement is made, and a timewise average of measured values is taken as a voltage value V12. In this sequence, the steps S205 to S208 are the measurement at the second pre-charging exposure light quantity I12.

The voltage values V11 and V12 and the light quantities I11 and I12 are stored in an unshown storing portion of an unshown acquiring portion 63B of the pre-exposure light quantity controller 63.

Then, a relational expression (2) between the voltage value measured by the charging measuring portion 22 and the pre-charging exposure light quantity is acquired from the voltage values V11 and V12 acquired by the acquiring portion 63B in the steps S104 and S108 and the light quantities I11 and I12 of the pre-charging exposure device at that time.

$$V=P\times I+V02 \quad (2)$$

In the above relational expression (2), P=(V12−V11)/(I12−I11). V02 represents a voltage value measured by the charging measuring portion 22 when the pre-charging exposure light quantity I is 0.

Then, a measurement voltage value Vp, at the charging roller 20, where the potential of the photosensitive drum 10 is desired pre-charging potential is acquired in advance, and the pre-exposure light quantity controller 63 acquires, from the relational expression (2), a light quantity Ip corresponding to the measurement voltage value Vp providing the desired pre-exposure potential (step S209). Finally, the pre-exposure light quantity controller 63 determines the acquired pre-charging exposure light quantity Ip as a pre-charging exposure light quantity used during the image formation (step S210), and then ends the light quantity determining sequence.

As described above, in this embodiment, at the different two pre-charging exposure light quantities I11 and I12, by measuring the voltage values V11 and V12 by the transfer measuring portion. As a result, P=(V12−V11)/(I12−I11) in the relational expression (2) is determined, and the pre-charging exposure light quantity is determined from the relational expression (2).

(Verification of Effect)

A verification test for verifying an effect of this embodiment will be described. In this verification test, a light quantity determining sequence for the pre-charging exposure device was performed in constitutions in First Embodiment and this embodiment (Second Embodiment), times required for performing the sequence were compared.

FIG. 8 is a table showing a result of the verification test, and shows a result of comparison of the times required for performing the light quantity determining sequence between this embodiment ("Second EMB.") and First Example ("First EMB.").

In the verification test, the photosensitive drum 10 was 24 mm in outer diameter, 210 mm/s in rotational speed, and 0.36 sec in time required for one full turn of the photosensitive drum 10. Further, a time of switching of the polarity of the potential outputted from the charging voltage source 20A in this embodiment was 0.10 sec.

From FIG. 8, the required time in the constitution in First Embodiment was 1.80 sec, whereas the required time in the constitution in Second Embodiment was 1.64 sec, and therefore it was understood that the time required for performing the light quantity determining sequence can be shortened by the constitution in this embodiment. It would be considered this is because in this embodiment, a distance from the pre-charging exposure device 60 to the image bearing member potential detecting member with respect to the rotational direction of the photosensitive drum 10 is short and the time until the region of the photosensitive drum 10 after the pre-charging exposure reaches the image bearing member potential detecting member can be shortened.

That is, in First Embodiment, the transfer roller 80 also functions as the image bearing member potential detecting member, whereas in this embodiment, the charging roller 20 also functions as the image bearing member potential detecting member, and therefore the time until the region subjected to the pre-charging exposure reaches the image bearing member potential detecting member is shorter in the constitution in this embodiment.

Therefore, compared with the constitution in First Embodiment, the time required for performing the light quantity determining sequence can be shortened in the constitution in this embodiment. However, the charging voltage source 20A (outputting the potentials of both (positive and negative) polarities) applying the potential in the second charging operation in this embodiment is higher in cost than the transfer voltage source 80A (outputting the potentials of both (positive and negative) polarities) in First Embodiment. For this reason, in the case where the time required for performing the light quantity determining sequence is intended to be shortened even when the cost increases, the constitution in this embodiment may preferably be selected.

(Modified Embodiment)

In the above, preferred embodiments of the present invention were described, but the present invention is not limited thereto. Various modifications and changes thereof can be made within the scope of the present invention.

(Modified Embodiment) 1

In the above-described embodiments, the measurement (of the voltage values V1 and V2 by the transfer measuring portion) at the plurality of the pre-charging exposure light quantities I1 and I2 was made, but the present invention is not limited thereto. That is, in the case where the value V01 (the voltage value measured by the transfer measuring portion 82 when the pre-charging exposure light quantity I is 0) in the relational expression (1) is acquired in advance, the measurement at a single pre-charging exposure light quantity may only be required to be made. That is, when two coordinate positions in an I-V coordinate system are determined, a rectilinear line passing through the two points is determined unambiguously, but as another method other than the use of the two points for measurement, a method using one point for measurement and a known one point may also be used.

(Modified Embodiment 2)

In the above-described embodiments, as the cartridge, the process cartridge including the image bearing member (photosensitive drum) and the developer carrying member (developing roller) was described. However, a cartridge which include a first unit (including the photosensitive drum 10, the charging roller 20, the cleaning device 50 and the pre-charging exposure device 60) including the image bearing member or a second unit (including the developing device 40) including the developer carrying member may also be used.

Further, the cartridge prepared by integrally assembling the photosensitive drum as the image bearing member and at least one of the charging means, the developing means, the pre-charging exposure means and the cleaning means which are the image forming process means actable on the photosensitive drum may be used.

Such a cartridge itself may also include a controller for determining the proper light quantity for the pre-charging exposure means or may also receive a signal from a separate control for determining the proper light quantity for the pre-charging exposure means.

(Modified Embodiment 3)

In the above-described embodiments, the measurement of the value of the voltage applied to the image bearing member potential detecting member when the constant-current control is made was described, but the measurement of the value of the current flowing through the image bearing member potential detecting member when the constant-voltage control is made may also be effected.

(Modified Embodiment 4)

In the above-described embodiments, the image forming apparatus in which the transfer material P in the recording material was described, but an image forming apparatus in which the transfer material P is an intermediary transfer belt for temporarily holding the toner image to be finally transferred onto the recording material may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-055898 filed on Mar. 19, 2015, which is hereby incorporated by reference herein in its entirety.

What is claimed is:

1. An image forming apparatus comprising:

an image bearing member;

a charging member for electrically charging said image bearing member at a charging portion;

a developing member for forming a developer image on said image bearing member charged by said charging member;

a transfer unit for transferring the developer image onto a transfer material at a transfer portion;

a pre-charging exposure unit for exposing to light a surface of said image bearing member which passes through the transfer portion and before said image bearing member reaches the charging portion;

a voltage receiving member for receiving a voltage;

a measuring portion for measuring a first value of a voltage applied to said voltage receiving member when constant-current control is effected; and a controller for determining a light quantity of said pre-charging exposure unit during image formation based at least on the measured first value of the voltage and a second value of the voltage, wherein said controller includes:

a light quantity controller for controlling the light quantity so that said image bearing member charged by applying a first potential to said charging member is exposed to light at a first light quantity by said pre-charging exposure unit, and an acquiring portion for acquiring an output of said measuring portion when said image bearing member exposed to light at the first light quantity is charged by applying a second potential of an opposite polarity to a polarity of the first potential to said voltage receiving member.

2. An image forming apparatus according to claim 1, wherein said light quantity controller controls the light quantity so that said image bearing member is exposed to light at the first light quantity and at a second light quantity different from the first light quantity by said pre-charging exposure unit, and wherein said acquiring portion acquires first and second outputs of said measuring portion corresponding to the first and second light quantities, respectively.

3. An image forming apparatus according to claim 1, wherein said controller calculates the light quantity, of said pre-charging exposure unit, at which the value of the voltage measured by said measuring portion is a predetermined value.

4. An image forming apparatus according to claim 1, wherein said controller executes, a first charging operation for charging said image bearing member by applying the first potential to said charging member, an exposure operation for exposing said image bearing member to light by said pre-charging exposure unit after the first charging operation is executed, a second charging operation for charging said image bearing member by applying the second potential after the exposure operation is executed, and a measuring operation for measuring the value of the voltage by said measuring portion during execution of the second charging operation, wherein said controller determines an output of said pre-charging exposure unit on the basis of a measurement result of measurement by the measuring operation.

5. An image forming apparatus according to claim 4, wherein the exposure operation is executed a plurality of times while changing the light quantity of said pre-charging exposure unit, and the measuring operation is also executed a plurality of times correspondingly to the exposure operation, and wherein said controller determines the light quantity of said pre-charging exposure unit on the basis of a plurality of measurement results of the plurality of measuring operations.

6. An image forming apparatus according to claim 3, wherein said controller calculates the light quantity of said pre-charging exposure unit at which the value of the voltage measured by said measuring portion is a predetermined value.

7. An image forming apparatus according to claim 1, wherein said charging member also functions as said voltage receiving member.

8. An image forming apparatus according to claim 1, wherein said transfer unit also functions as said voltage receiving member.

9. An image forming apparatus according to claim 4, wherein a rotational speed of said image bearing member during determination of the output of the pre-charging exposure unit is slower than a rotational speed of said image bearing member during image formation in which the developer image is formed on said image bearing member.

10. The image forming apparatus according to claim 1, wherein the second value of the voltage is obtained in advance.

11. A cartridge detachably mountable to a main assembly of an image forming apparatus, said cartridge comprising:

an image bearing member on which a developer image to be transferred onto a transfer material at a transfer portion is to be formed;

a charging member for electrically charging said image bearing member at a charging portion;

a pre-charging exposure unit for exposing to light a surface of said image bearing member which passes through the transfer portion and before said image bearing member reaches the charging portion; and a controller for determining a light quantity of said pre-charging exposure unit during image formation based at least on the measured first value of the voltage and a second value of the voltage, wherein said controller includes:

a light quantity controller for controlling the light quantity so that said image bearing member charged by applying a first potential to said charging member is exposed to light at a first light quantity by said pre-charging exposure unit, and an acquiring portion for acquiring an output of a measuring portion when said image bearing member exposed to light at the first light quantity is charged by applying a second potential of an opposite polarity to a polarity of the first potential to a voltage receiving member, wherein the measuring portion measures a value of a voltage applied to the voltage receiving member when constant-current control is effected.

12. A cartridge according to claim 11, wherein said light quantity controller controls the light quantity so that said image bearing member is exposed to light at the first light quantity and at a second light quantity different from the first light quantity by said pre-charging exposure unit, and acquires first and second outputs of said measuring portion corresponding to the first and second light quantities, respectively, to determine a light quantity during image formation.

13. A cartridge according to claim 11, wherein said controller calculates the light quantity, of said pre-charging exposure unit, at which the value of the voltage measured by said measuring portion is a predetermined value.

14. The image forming apparatus according to claim 11, wherein the second value of the voltage is obtained in advance.

* * * * *